US010144562B1

(12) United States Patent
Latimer

(10) Patent No.: US 10,144,562 B1
(45) Date of Patent: Dec. 4, 2018

(54) VACUUM BREAKER VALVES FOR FUEL CANISTERS

(71) Applicant: Greg Latimer, Aumsville, OR (US)

(72) Inventor: Greg Latimer, Aumsville, OR (US)

( * ) Notice: Subject to any disclaimer, the term of this patent is extended or adjusted under 35 U.S.C. 154(b) by 0 days.

(21) Appl. No.: 15/892,212

(22) Filed: Feb. 8, 2018

Related U.S. Application Data

(60) Provisional application No. 62/515,750, filed on Jun. 6, 2017.

(51) Int. Cl.

| | |
|---|---|
| ***B67D 3/00*** | (2006.01) |
| ***B65D 51/16*** | (2006.01) |
| ***B65D 47/32*** | (2006.01) |
| ***B65D 47/24*** | (2006.01) |

(52) U.S. Cl.
CPC ..... *B65D 51/1644* (2013.01); *B65D 47/243* (2013.01); *B65D 47/32* (2013.01)

(58) Field of Classification Search
CPC .. B65D 51/1644; B65D 47/243; B65D 47/32; B67D 7/005
USPC ..... 222/481.5, 188
See application file for complete search history.

(56) References Cited

U.S. PATENT DOCUMENTS 4,928,861 A * 5/1990 Schiemann ..... B65D 1/20 222/189.07
5,076,333 A * 12/1991 Law ..... B65D 47/283 141/198
5,079,013 A * 1/1992 Belanger ..... A47G 19/2272 215/11.4
5,234,038 A * 8/1993 Mitchell ..... B67D 7/54 141/291
5,249,611 A * 10/1993 Law ..... B65D 25/48 141/198
5,560,522 A * 10/1996 Clark ..... B65D 47/20 141/335
5,704,408 A * 1/1998 Law ..... B65D 25/48 141/198
7,959,044 B1 * 6/2011 Christian ..... B65D 1/20 215/902
2013/0140334 A1 * 6/2013 Abell ..... B65D 25/48 222/527

* cited by examiner

*Primary Examiner* — Jeremy W Carroll

(57) ABSTRACT

The present disclosure is directed to devices for dispensing liquid, especially fuel. In one embodiment, a device for dispensing fuel includes a spout for pouring liquid fuel, an annular fitting including a chamber formed therein. A sealing surface, a stopper, and spring may be disposed within the chamber. The annular fitting may be attached to the spout. The annular fitting may be configured to mate with a portable fuel canister. The fitting may include sidewalls forming a channel for liquid fuel, an outer wall enveloping a portion of the sidewall forming a chamber proximate the liquid channel, and an atmospheric orifice formed in the outer wall. The sealing surface may be disposed proximal the orifice. The spring may be configured to bias the stopper into contact with the sealing surface such that the chamber is in selective pressure-dependent fluid communication with an atmosphere outside the device.

13 Claims, 3 Drawing Sheets

VACUUM BREAKER VALVES FOR FUEL CANISTERS

CROSS REFERENCE TO RELATED APPLICATIONS

This application claims priority to U.S. Application Ser. No. 62/515,750, filed on Jun. 6, 2017, which is hereby incorporated by reference for all purposes.

BACKGROUND

The present disclosure relates generally to liquid dispensing devices. In particular, portable liquid dispensing devices including vacuum breaker valves are described. The liquid dispensing devices described herein may be particularly suited for liquid fuel, however dispensing other liquids is also contemplated.

Gas cans and liquid containers are an easy way to move and transport fuel and other liquids. Common types of portable gas containers and other portable liquid containers are designed with the spout on the top of the container, thus the container must be inverted in order to dispense liquid. However, the known liquid containers are not entirely satisfactory for the range of applications in which they are employed. For example, existing liquid containers generally lack a vacuum breaker valve. Thus, when the containers are inverted to dispense liquid, a vacuum may form above the liquid as the liquid level drains. This vacuum above the liquid in the inverted container may hinder the flow of liquid out of the spout and may also cause surging in the flow of liquid.

Thus, there exists a need for liquid containers that improve upon and advance the design of known liquid containers. Examples of new and useful liquid containers relevant to the needs existing in the field are discussed below.

SUMMARY

The present disclosure is directed to devices for dispensing liquid, especially fuel. In one embodiment, a device for dispensing fuel includes a spout for pouring liquid fuel, an annular fitting including a chamber formed therein. A sealing surface, a stopper, and spring may be disposed within the chamber. The annular fitting may be attached to the spout. The annular fitting may be configured to mate with a portable fuel canister. The fitting may include sidewalls forming a channel for liquid fuel, an outer wall enveloping a portion of the sidewall forming a chamber proximate the liquid channel, and an atmospheric orifice formed in the outer wall. The sealing surface may be disposed proximal the orifice. The spring may be configured to bias the stopper into contact with the sealing surface such that the chamber is in selective pressure-dependent fluid communication with an atmosphere outside the device.

In some embodiments, the device may include a hose connected to the chamber within the container and running toward the bottom of the container. Thus the hose may be configured to place the chamber in fluid communication with a remote location within the fuel canister.

DETAILED DESCRIPTION

The disclosed liquid dispensing devices will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various liquid dispensing devices are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
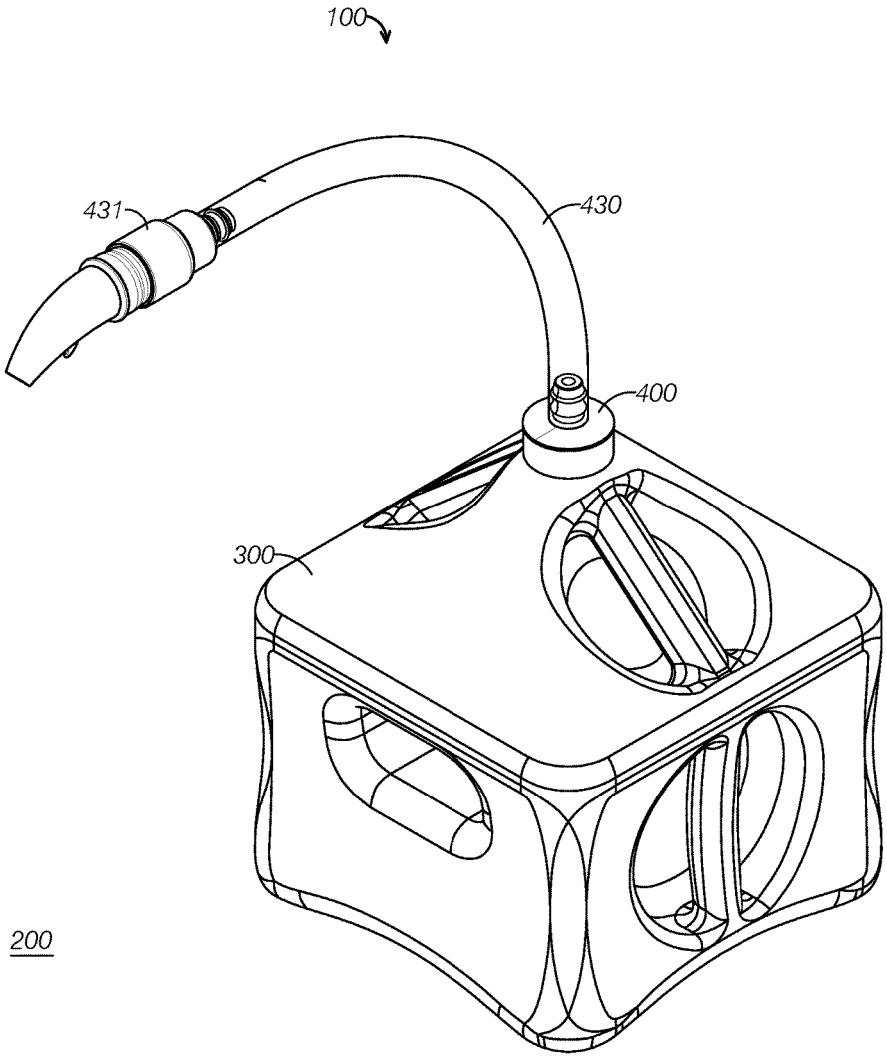
FIG. 1 is perspective view of one embodiment of a fuel dispensing device including a fuel container and a fuel spout with associated vacuum breaker valve.
Figure 2:
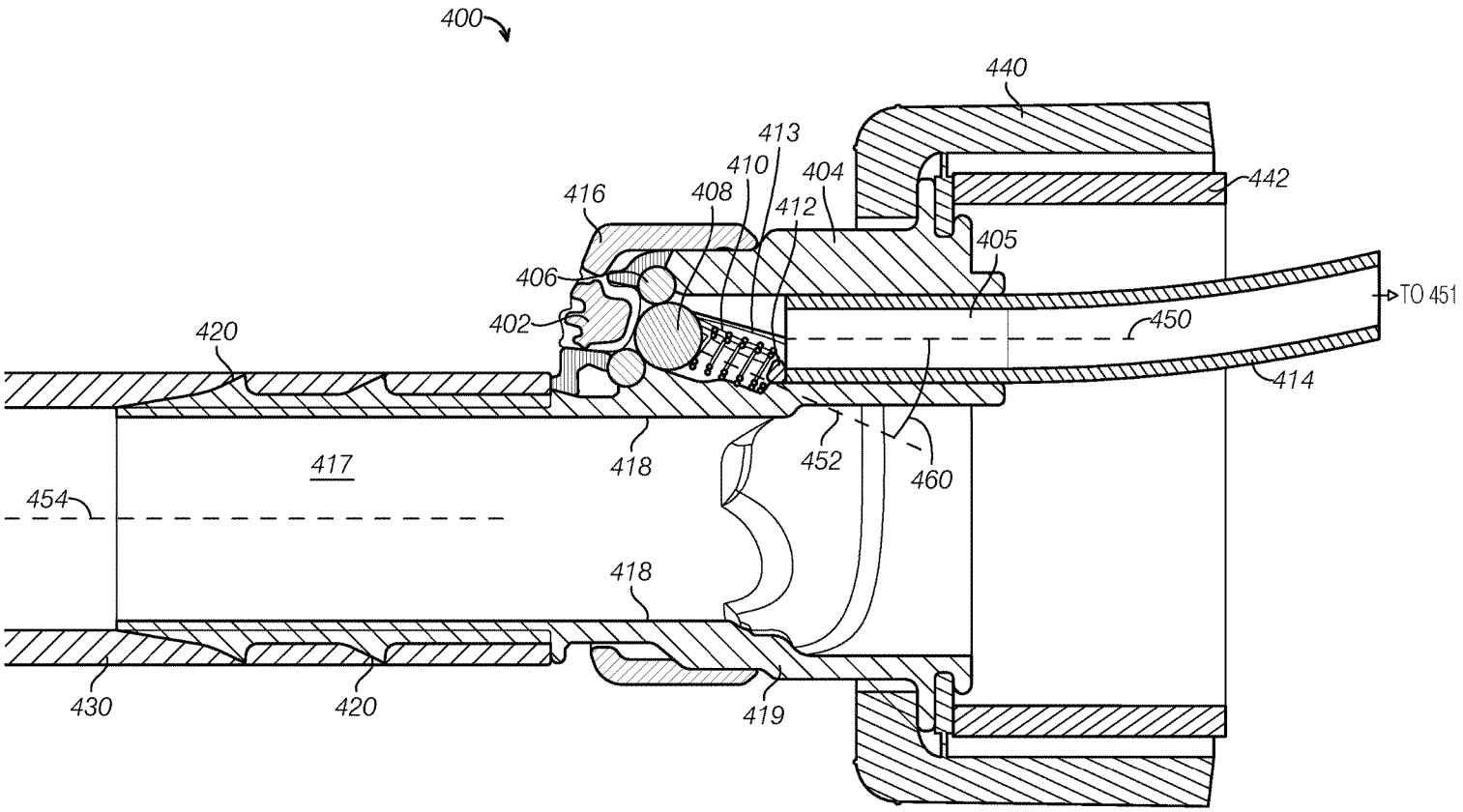
FIG. 2 is a cross section of the fuel spout and vacuum breaker valve of FIG. 1.

With reference to FIGS. 1-2, a first example of a liquid dispensing device, fuel dispensing device 400, will now be described. Device 400 functions to dispense liquid fuel from a portable liquid fuel container 300 while simultaneously regulating the gas pressure above the liquid fuel when the container 300 is inverted. More specifically, device 400 functions to break the vacuum formed above the liquid fuel in the container 300 when the container 300 is inverted and fuel flows from the fuel spout of the device. Device 400 and container 300 comprise a fuel dispensing system 100. The reader will appreciate from the figures and description below that device 400 addresses shortcomings of conventional devices.

For example, device 400 functions to equalize pressure between an atmosphere above the liquid in an inverted liquid container and the ambient atmosphere outside the liquid. Thus, device 400 may achieve a steady flow of liquid from the spout.

Device 400 includes a spout 420 for pouring liquid fuel, an annular fitting 419 including a chamber 405 formed therein. A sealing surface 406, a stopper 408, and spring 410 may be disposed within chamber 405. The annular fitting 419 may be attached to spout 420. The annular fitting 419 may be configured to mate with a portable fuel canister 300. Fitting 419 may include sidewalls 418 forming a channel 417 for liquid fuel, an outer wall 404 enveloping a portion of the sidewall 418 forming chamber 405 proximate the liquid channel 417, and an atmospheric orifice 402 formed in the outer wall 404. The sealing surface 406 may be disposed proximal orifice 402. The spring 410 may be configured to bias the stopper 408 into contact with the sealing surface 406 such that the chamber 405 is in selective pressure-dependent fluid communication with an atmosphere 200 outside the device.

Device 400 may be secured to liquid container 300. A hose 430 may connect device 400 to a dispensing nozzle 431. An air intake may be included in the liquid container 300 to allow air to flow into the container 300 to take the place of the displaced liquid as the liquid is poured out of the liquid container. As can be seen in FIG. 2, an example of a possible air intake may be a spout check device 400, and may include an orifice 402 located in an outer wall 404 of device 400. The orifice 402 in the wall 404 may allow air to enter into the liquid container from the outside atmosphere. Surrounding the orifice 402, there may be a sealing surface 406 which may be made from a rubber or elastic, or other material, to seal the orifice when liquid is not poured, or when it is not desirable for air to pass through the orifice 402.

As can be seen in FIG. 2, the spout check 400 may include a stopper 408 which may interact with the sealing surface 406 to seal the orifice 402 and make the liquid container air or liquid tight, or spill resistant. In the illustrated embodiment, the stopper 408 may be a ball bearing, where the ball bearing is the same size and shape, or a similar or slightly larger size and shape, as the orifice 402 and the gasket 406 surrounding the orifice. Because the ball bearing stopper 408 may be similarly sized, or slightly larger than the orifice 402 and sealing surface 406, the stopper 408 will fully seal the orifice 402 when it is pressed against the orifice 402 and sealing surface 406. In the illustrated embodiment, the sealing surface 406 comprises an O-ring. In other embodiments, the sealing surface may comprise a gasket or may be an integral part of the annular fitting.

Still as seen in FIG. 2, in order to hold the stopper 408 in place against the orifice 402 or gasket 406, a spring 410 is compressed slightly in place within the wall 404 of the nozzle or liquid container in a position behind the stopper 408. The spring 410 is positioned to press the stopper 408 toward the orifice 402, and at an opposite end, the spring 410 presses against a spring stop 412. The spring stop 412 may be a protruding edge of the wall 404, or may be part of a recess in the wall 404.

As is seen in FIG. 2, the spout check may include a spout hose 414 to assist in moving air into the liquid container. The spout hose 414 may be a small, cylindrical and flexible or rigid hose extending from the orifice 402 of the device 400 into the liquid container 300 to move air past liquid that may be contained within the liquid container during pouring. The spout hose 414 may fit by interfacing with the walls 404 of the nozzle or liquid container, and may be held in place by friction or tension or compression fitting.

The device 400 may function by allowing air intake through the orifice 402 during pouring of the liquid container and the stopper 408 automatically resealing the orifice 402 when pouring stops. This is possible because as liquid is poured from the otherwise air and liquid tight liquid container, a vacuum is formed within the liquid container above the displaced liquid. The low pressure of the liquid container will create a natural sucking action, and the orifice 402 may allow air to be sucked into the liquid container.

As air is sucked through the orifice 402, the stopper 408 is displaced, and the spring 410 is compressed by the forces acting on it. As pouring slows or ceases from the liquid container 300, the difference in pressure will also slow or cease, creating equal pressures once again. Because there is equal pressure inside the container as there is outside, the sucking action of air through the orifice 402 will cease, and the spring 410 will extend and press the stopper against the gasket 406 or orifice 402, again creating a sealed container.

As described above, hose 414 may assist in moving air into container 300. Specifically, one end of the hose may be connected to chamber 405 and the other end of the hose may terminate in a remote location of the canister, such as the bottom. Thus, hose 414 may be configured to place the chamber 405 in fluid communication with the remote location 451 within the fuel canister 300.

As can be seen in FIG. 2, the annular fitting 419 may comprise an annular cap 416 encircling the sidewalls of the spout 420 and covering one end of the chamber 405. The atmospheric orifice 402 may be formed in the cap 416.

Chamber 405 may include a groove 413 formed therein. The ball stopper 408 may be slidably retained in the groove 413 and configured to guide the ball stopper 408 into contact with the sealing surface 406. The groove 413 may be formed at an angle to chamber 405 in order to allow air to rush past the ball stopper when it is retracted. Specifically, groove 413 may have a first long axis 452 and the chamber 405 may have a second long axis 450, wherein the first long axis 452 forms an angle 460 with the second long axis 450 of a least 10 degrees. The channel 405 may have a third long axis 454, wherein the second long axis 450 is parallel to the third long axis 454.

Device 400 may be secured to container 300 via retaining cap 440. For example, a flange at the proximal end of annular fitting 419 may be sandwiched between retaining cap 440 and the neck of container orifice 442.

Figure 3:
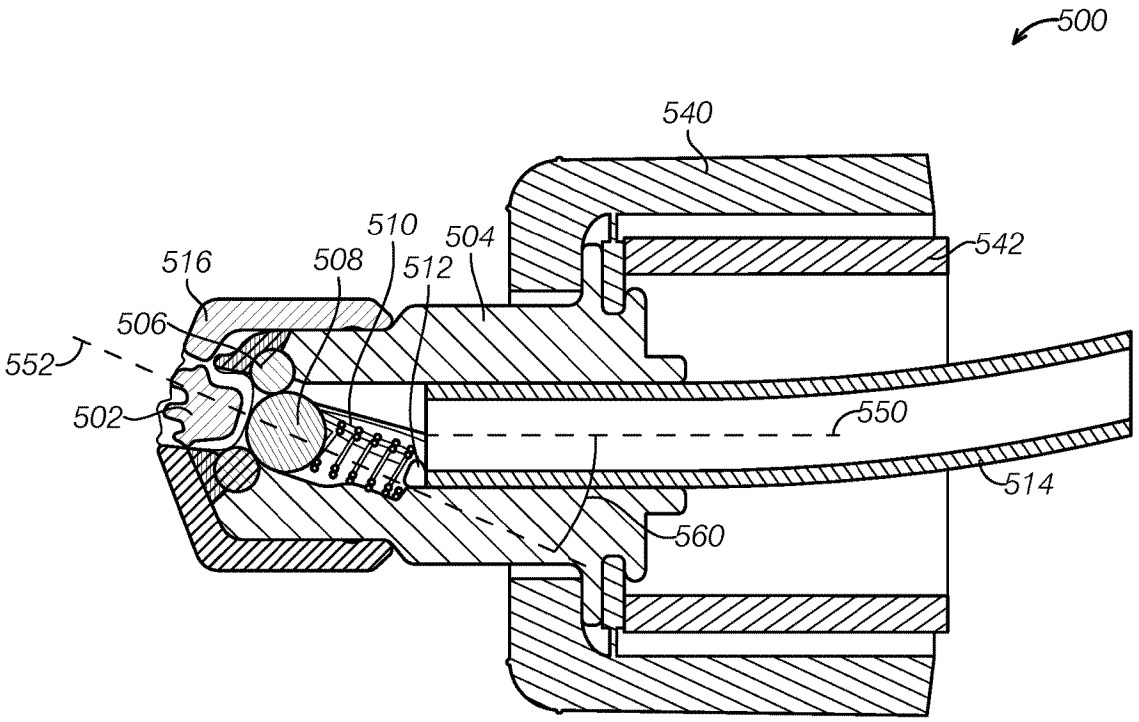
FIG. 3 is a cross section of a second embodiment of a vacuum breaker valve.

Turning now to FIG. 3, a second embodiment of a vacuum breaker valve device, device 500, will now be described. Device 500 shares many characteristics with device 400, thus only the differences will be explained. Device 500 is configured as a stand-alone vacuum breaker device, rather than the integrated spout and check valve of device 400.

As can be seen in FIG. 3, device 500 includes a valve body 504. The valve body may be attached to a fuel canister orifice 542 via a retaining cap 540. The valve body 504 may have a chamber formed therein. The chamber may have a first end and a second end. An atmospheric orifice 502 may be formed in the valve body 504, proximal the first end of the chamber. A sealing surface may be 506 may be disposed within the chamber, proximal the orifice 502. A stopper 508 may be disposed within the chamber. A spring 510 may be disposed within the chamber. Spring 510 may be configured to bias the stopper 508 into contact with the sealing surface 506 such that the chamber is in selective pressure-dependent fluid communication with an atmosphere outside the fuel canister.

In order to hold the stopper 508 in place against the orifice 502 or sealing surface 506, spring 510 is compressed slightly in place within the wall of the nozzle or liquid container in a position behind the stopper 508. The spring 510 is positioned to press the stopper 508 toward the orifice 502, and at an opposite end, the spring 510 presses against a spring stop 512. The spring stop 512 may be a protruding edge of the wall, or may be part of a recess in the wall.

Device 500 may comprise an annular cap 516 covering one end of the chamber 405. The atmospheric orifice 502 may be formed in the cap 516.

Device 500 may include a hose 514 configured to place the chamber in fluid communication with a remote location within the fuel canister. The chamber may include a groove formed therein. The ball stopper 508 may be slidably retained in the groove and configured to guide the ball stopper 508 into contact with the sealing surface 506. The groove may be formed at an angle to the chamber in order to allow air to rush past the ball stopper when it is retracted. Specifically, the groove may have a first long axis 552 and the chamber may have a second long axis 550, wherein the first long axis 552 forms an angle 560 with the second long axis 550 of a least 10 degrees.

Hose 514 may assist in moving air into the container. Specifically, one end of the hose may be connected to the chamber and the other end of the hose may terminate in a remote location of the canister, such as the bottom. Thus, hose 514 may be configured to place the chamber in fluid communication with the remote location within the fuel canister.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A device for dispensing fuel, comprising:
- a spout for pouring liquid fuel;
- an annular fitting attached to the spout configured to mate with a portable fuel canister, the fitting having;
  - sidewalls forming a channel for liquid fuel;
  - an outer wall enveloping a portion of the sidewall forming a chamber proximate the liquid channel;
  - an atmospheric orifice formed in the outer wall; and
  - wherein the annular fitting comprises an annular cap encircling the sidewalls of the spout and covering one end of the chamber, the atmospheric orifice being formed in the cap;
- a sealing surface disposed within the chamber, proximal the atmospheric orifice;
- a stopper disposed within the chamber; and
- a spring configured to bias the stopper into contact with the sealing surface such that the chamber is in selective pressure-dependent fluid communication with an atmosphere outside the device.

2. The device of claim 1 comprising a hose configured to place the chamber in fluid communication with a remote location within the fuel canister.

3. The device of claim 2, wherein the remote location is a bottom portion of the fuel canister.

4. The device of claim 1, wherein the sealing surface is a surface of a gasket disposed in the chamber proximal the atmospheric orifice.

5. The device of claim 1, wherein the stopper comprises a ball stopper.

6. The device of claim 5, wherein the chamber includes a groove formed therein, the ball stopper being slidably retained in the groove and configured to guide the ball stopper into contact with the sealing surface.

7. The device of claim 6, the groove having a first long axis and the chamber having a second long axis, wherein the first long axis forms an angle with the second long axis of a least 10 degrees.

8. A device for dispensing fuel, comprising:
- a spout for pouring liquid fuel;
- an annular fitting attached to the spout, the spout being mated with a portable fuel canister, the fitting having;
  - sidewalls forming a channel for liquid fuel;
  - an outer wall enveloping a portion of the sidewall forming a chamber proximate the liquid channel;
  - an atmospheric orifice formed in the outer wall; and
  - wherein the annular fitting comprises an annular cap encircling the sidewalls of the spout and covering one end of the chamber, the atmospheric orifice being formed in the cap;
- a sealing surface disposed within the chamber, proximal the atmospheric orifice;
- a stopper disposed within the chamber; and
- a spring configured to bias the stopper into contact with the sealing surface such that the chamber is in selective pressure-dependent fluid communication with an atmosphere outside the fuel canister; and
- a hose configured to place the chamber in fluid communication with a remote location within the fuel canister.

9. The device of claim 8, wherein the remote location is a bottom portion of the fuel canister.

10. The device of claim 8, wherein the sealing surface is a surface of a gasket disposed in the chamber proximal the atmospheric orifice.

11. The device of claim 8, wherein the stopper comprises a ball stopper.

12. The device of claim 11, wherein the chamber includes a groove formed therein, the ball stopper being slidably retained in the groove and configured to guide the ball stopper into contact with the sealing surface.

13. The device of claim 12, the groove having a first long axis and the chamber having a second long axis, wherein the first long axis forms an angle with the second long axis of a least 10 degrees.

* * * * *